United States Patent [19]

Facto

[11] Patent Number: 4,515,263

[45] Date of Patent: May 7, 1985

[54] COIN OPERATED MECHANISM FOR OPENING THE DOOR OF A CABINET

[76] Inventor: Archibald R. Facto, 17 Lormar Dr., Toronto, Ontario, Canada, M9B 4V7

[21] Appl. No.: 496,019

[22] Filed: May 19, 1983

[51] Int. Cl.[3] ..... G07F 9/04

[52] U.S. Cl. ..... 194/1 D; 194/54

[58] Field of Search ..... 194/54, 1 D, DIG. 29, 194/1 G, DIG. 15, DIG. 27, DIG. 28

[56] References Cited

U.S. PATENT DOCUMENTS

| | | |
|---|---|---|
| 1,947,767 | 2/1934 | Gilchrist . |
| 2,925,898 | 2/1960 | Terry . |
| 3,174,608 | 3/1965 | Knickerbocker . |
| 3,253,690 | 5/1966 | Brewton et al. . |
| 3,265,177 | 8/1966 | Knickerbocker . |
| 3,403,765 | 10/1968 | Knickerbocker . |
| 3,503,482 | 3/1970 | Davis . |
| 3,760,923 | 9/1973 | Voegeli . |
| 3,870,136 | 3/1975 | Voegeli . |
| 4,175,989 | 11/1979 | Pospischil et al. . |
| 4,375,844 | 3/1983 | Facto . |

*Primary Examiner*—Stanley H. Tollberg
*Attorney, Agent, or Firm*—Donald E. Hewson

[57] ABSTRACT

Coin operated newspaper sales cabinets conventionally are provided with a coin-return facility. The invention seeks to avoid the complexity of known coin-return mechanisms. It is known to provide a latch plate mounted on a pivot for tipping to unlatch the door. The invention uses the plate and its already-provided tipping ability to deflect coins into a coin return tray when the coin-return lever is operated. A subsidiary hook or latch comes into operation when the coin return lever is operated, so as to hold the door closed.

25 Claims, 12 Drawing Figures

COIN OPERATED MECHANISM FOR OPENING THE DOOR OF A CABINET

BACKGROUND TO THE INVENTION

This invention is in the field of coin-responsive mechanisms, particularly those used in coin-operated display and sales cabinets for newspapers.

Such cabinets conventionally include a door which is normally latched closed, but which is unlatched and can be opened when the correct money is inserted. The present invention is mainly but not exclusively concerned with the coin-return facility of the mechanism.

It is a feature of such mechanisms that they include complementary latch members mounted one on the door and one on the fixed part of the cabinet. One of these latch members is movable, and is spring biassed to a normal position. In that position the latch members are engaged and the door cannot be opened. To open the door, an unlatching means is provided to overcome the spring biassing and to move the one latch member away from its normal position, and to move it enough for the latch members to become disengaged. Of course, it is arranged that the operation of the part of the mechanism that moves the movable latch member is dependent on the presence of correct coinage in the mechanism.

The means that causes the latch members to become disengaged in this fashion includes a chute-closure member that normally is spring biassed against the bottom of the chute, and prevents a coin in the chute from falling therefrom. The chute closure member is movable downwards, against the spring biassing. Like one or other of the latch members, the chute closure member is constrained to move with the door as the door is opened: as the door is opened, the chute closure member is withdrawn transversely away from the bottom of the chute. Coins in the chute therefore fall from the chute when this happens, and it is arranged that the money falls into an accepted-coin tray. The ability of the chute-closure member also to move downwards is made use of in the following manner: one way "check valves" are arranged in the chutes to trap coins in the chutes when those coins total the desired amount; now, when the door is drawn open, a coin contacting surface on the chute closure member engages the lowermost of the coins; the closure member is thus pressed downwards as it is withdrawn, since the coins are prevented from moving upwards by the valve. This downwards movement of the closure member is arranged to be the means whereby the one of the latch members is moved and disengaged to allow the door-opening movement to continue.

Although it need not be so, it is conventionally arranged that the movable chute-closure member and the movable one of the latch members are one and the same piece. The composite member is pivoted directly to the door, and the one pivot serves therefore for both the latch member, and for the downward movement of the closure member.

There are quite a number of other operative principles taught in the prior art for providing a latch that becomes disengaged when correct coinage is inserted in the mechanism. The principle described above, which may be termed the "trapped-coins-push-latch-down" principle, has led to the most successful mechanisms, because it permits the various components of the mechanism to be arranged neatly and simply.

It is relatively easy to design the component pieces so that they are all adequately robust, and adequately mounted, and so that they perform their functions and interactions with each other reliably, and can be made and assembled without difficulty; all in the manner of elegant engineering designs whatever the field of application.

Except, that is, for the coin-return facility. Accommodating a coin-return facility has hitherto prevented mechanisms based on this principle from realising the full potential degree of basic simplicity. The simple mechanism of a closure member spring-biassed against the bottom of the coin chute does not lend itself to the provision of a coin-return facility. The main difficulty lies in diverting the coins that are to be returned away from the entry to the accepted-coin tray and into the mouth of the coin-return tray.

One measure hitherto popular has been to provide a movable chute, which when a person presses a coin return button, moves so that the bottom of the chute is now over the mouth of the return tray. Such a movable chute is shown for example in U.S. Pat. No. 4,375,844 (FACTO, Mar. 8, 1983). The provision of a movable chute of course takes away most of the basic simplicity of the "trapped-coins-push-latch-down" concept.

Another measure has been to provide a sloping chute. Here, the chute is arranged to burst open when a coin-return button is pressed, and coins fall not from the end or bottom of the chute but from its intermediate length, and the return tray catches coins that fall in this manner. Only if a coin reaches the very end of the chute does it fall into the accepted tray. The chute does not have to move, which is a bonus, but the space taken by the sloping chute makes for mounting and fixing difficulties. U.S. Pat. No. 3,253,690 BREWTON (May 31, 1966) shows a mechanism like that.

Yet another measure taken to return the coins has been to work the cabinet door back and forth (through the small amount of travel permitted due to free play in the latch); an action that imparts an impulse to an improper coin to flick it into the return tray. Again, this detracts from the basic simplicity of the design. U.S. Pat. No. 2,925,898, issued Feb. 23, 1960 to TERRY, shows a mechanism like that.

Yet another measure has been to provide that the latch plate/closure member moves sideways. When the coin return button is pressed a scoop pushes aside the closure member, and moves into position below the chute (which in this case need not itself move). The coins in the chute fall onto the scoop and are diverted into the return tray. The latch plate/closure member has to be guided for sideways sliding as well as for its normal pivoting movement, and sideways sliding along a pivot pin is not an easy thing to accomplish in a trouble free manner particularly as the components are exposed to occasional abuse and vandalism and to extremes of the weather. U.S. Pat. No. 3,870,136 (VOEGELI, Mar. 11, 1975) shows a mechanism like that.

BRIEF DESCRIPTION OF THE INVENTION

A feature of the invention is the recognition of the following circumstance. The closure-member is already provided with the ability to move downwards, when the door is being opened. Therefore, the closure member is provided with pivots or other guide means, whether or not the closure member and the latch member are one and the same piece. In the present invention, the action of operating the coin return facility simply repeats that same motion of the closure member that the closure member undergoes when the door is opened, but now with the closure member remaining in position at the bottom of the chute. Thus, when the coin return facility is in operation, coins resting on the closure-member roll or slide down the closure-member to wherever the member tends to urge them, and, of course, it is arranged that the closure-member diverts the coins into the mouth of the return tray. The door of the cabinet remains closed during a coin-return operation, so the closure member is not withdrawn from the bottom of the chute: thus the closure member blocks entry to the accepted-coin chute, as well as diverting coins to the return chute, which makes for extra reliable operation.

This use of an already-provided mounting and guiding means is in keeping with the basic simplicity and neatness that is associated with mechanisms constructed in accordance with the "trapped-coins-push-latch-down" principle. The vast simplification compared with the prior art constructions will be appreciated from the detailed description of an embodiment of the invention that follows. It should be noted that in previous mechanisms, when the closure member has moved downwards, that movement has been effective to unlatch the latch members and to allow the door to open. In the present invention, that same downwards movement of the closure member that opens the door is now to be used to return the coins. It might seem as if all one need do to open the door is to press the coin return button. This apparent contradiction in function probably accounts for why the enormous benefits of arranging the coin-return facility as in the manner of the invention had not previously been recognized. For it is recognized also in the invention that operation of the coin-return facility can quite easily include the bringing into effect of a subsidiary latch or blocking means that holds the door closed while the coin-return facility is in operation.

The closure member is the means whereby coins are diverted into the mouth of the coin return chute, in the present invention: therefore, neither the coin chute nor anything else need be movable to carry out that requirement. The fewer moving parts the better, in a cabinet that is exposed to the weather.

A benefit of the fewer moving parts required in the invention is that the "coin check valves" referred to above can be mounted on a fixed structure. These valves comprise pawls that swing on pivots and they have to be quite delicately constructed and mounted. In the invention these pawls can be mounted on a separate block which is simply bolted in place: an unskilled person can unscrew a block having worn pawls, and bolt in a new block, having neither to make any adjustments or settings, nor to connect up any springs or pivots or other components. Similarly, when a change in pricing policy necessitates a new set of pawls, the whole block is again simply replaced without any skill being required. Even if the mounting of the pawls is sufficiently well engineered to make the incidence of seizing up of the pivots practically negligible, still the fear of the person who will own and maintain the cabinets is not always alleviated, that he will have to make numerous service calls to replace the pawls. The easy replacement of the pawl block satisfies such a person that if a repairman has to make such service calls, he can at least make the repairs inexpensively.

It is another aspect of conventional practice that the walls of a coin chute can be moved apart with respect to each other when the coin return facility is in operation, in order to allow coins that are jammed in the chute to be cleared. When the chute itself was movable as in prior art constructions, the provision of the facility of the openable walls gave rise to extra complication. In the present invention, the general simplicity of the mechanism means that the walls can be opened by guiding them on hinges that are mounted in the fixed frame of the mechanism, which again greatly simplifies construction.

Another aspect also of conventional practice has been that the mechanism is provided with a simple-to-operate price change facility. Thus, a change can be made from daily-paper price to Sunday-paper price, and back, just by turning a key. Again, complication was caused in the prior art mechanisms by the fact that the price-change facility had to be provided alongside whatever means was employed to direct coins into the return chute. When such a price change facility is provided in the mechanism of the present invention, the fixed chute and lack of other moving parts permitted by the invention means that the construction of the price change facility may be greatly simplified.

DETAILED DESCRIPTION OF A PREFERRED EMBODIMENT

An exemplary embodment of the invention will now be described, with reference to the accompaying drawings.

CONSTRUCTION OF THE BASIC CABINET

Figure 1:
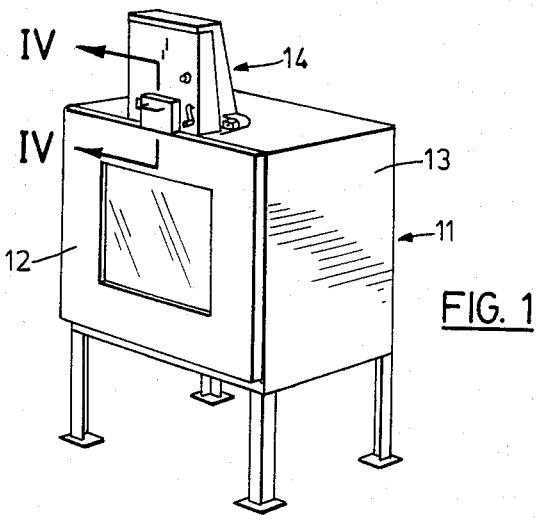
FIG. 1 shows a newspaper vending cabinet having a coin-responsive mechanism.
Figure 2:
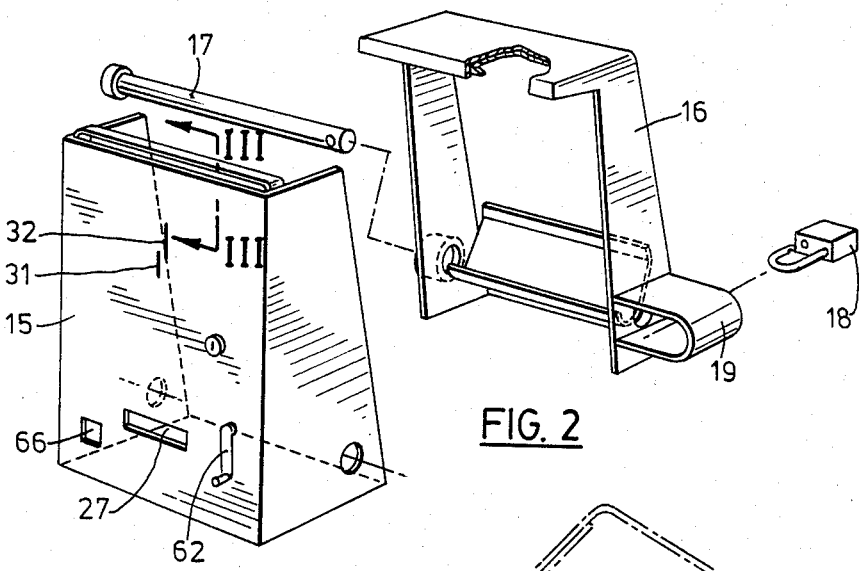
FIG. 2 is an exploded view of a hood structure forming part of the cabinet.
Figure 3:
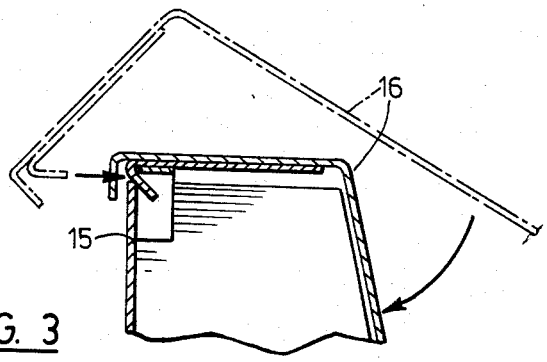
FIG. 3 is a section along line III—III of FIG. 2.

The cabinet 11 shown in FIG. 1 has a door 12, and has a fixed part which includes a case 13 and a hood 14. The hood 14, shown again in FIGS. 2 and 3, has a front plate 15 and a cover 16, which fit together in the manner of a separable hinge, as illustrated in FIG. 3. The front plate 15 is bolted to the top of the case 13, and the cover 16 is locked to the front plate 15 by means of the pin 17 and padlock 18 shown in FIG. 2. A shield 19 is provided on the cover 16 to prevent thieves forcing the padlock 18. Coins used to open the door of the cabinet collect inside the hood and can be recovered by unlocking the padlock to open up the hood. The structure of the front of the hood at the top, as shown in FIG. 3, precludes vandalism and theft from the hood.

CONSTRUCTION OF THE DOOR LATCH ASSEMBLY

Figure 4:
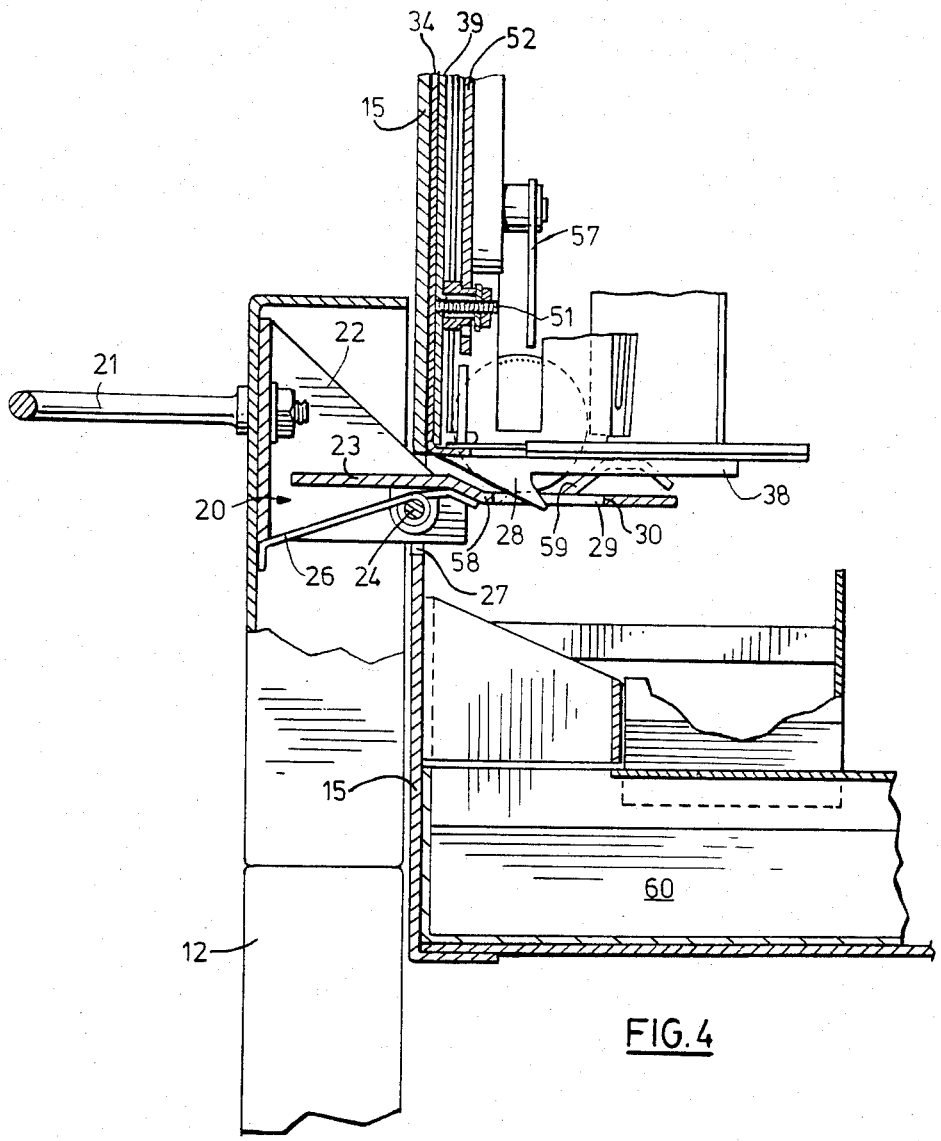
FIG. 4 is a section along line IV—IV of FIG. 1.
Figure 5:
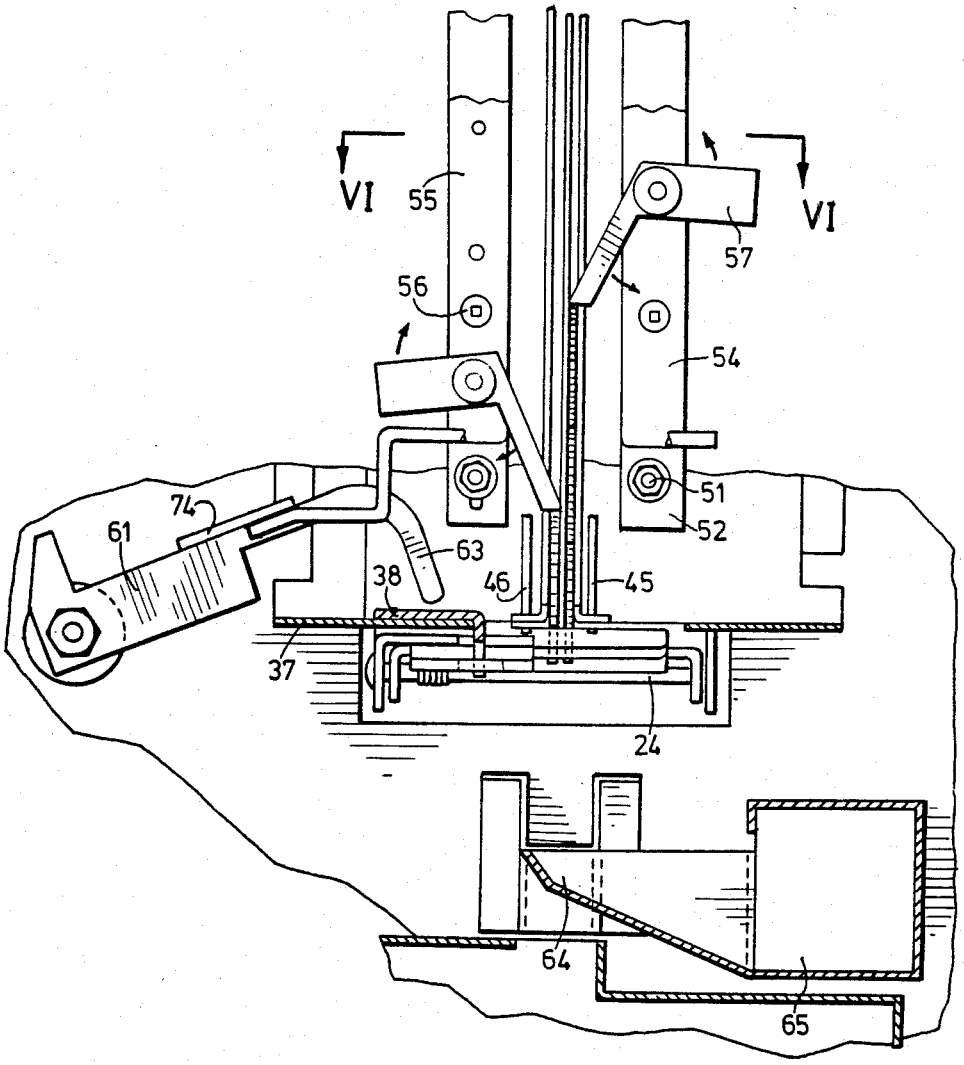
FIG. 5 is a view in the direction of arrow V in FIG. 4.
Figure 10:
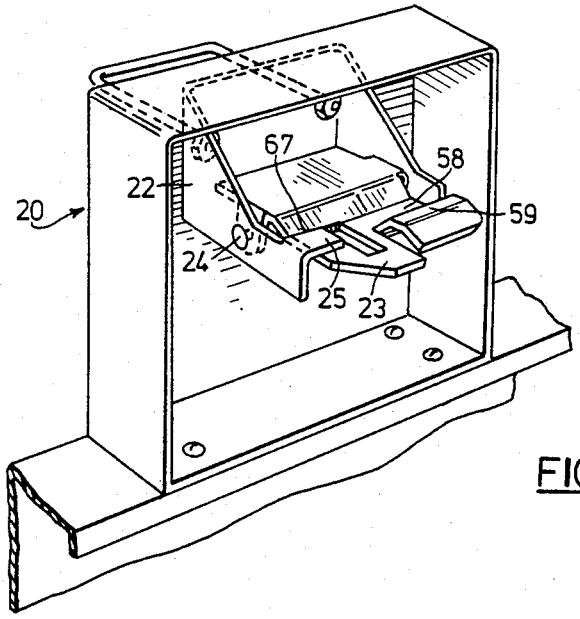
FIG. 10 is a pictorial view of part of the door of the cabinet.
Figure 12:
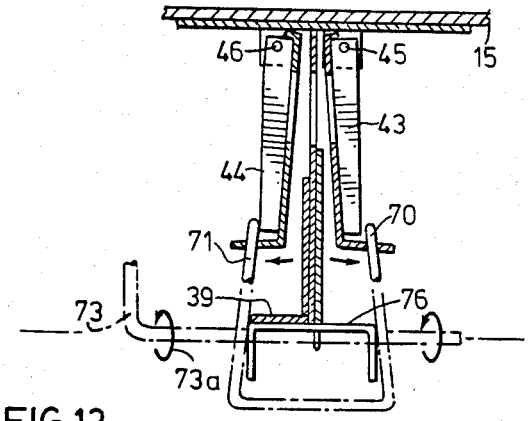
FIG. 12 is a section along line XII—XII of FIG. 11.

Fixed on top of the door 12 is a door-latch assembly 20, shown pictorially in FIG. 10, and in section in FIG. 4. The door-latch assembly 20 includes a handle 21 which is pulled by a person who wishes to open the door. The assembly 20 also includes a bracket 22 which, like the handle 21, is firmly fixed to the door 13.

A latch-plate 23 is mounted on a pivot 24 so that the latch-plate 23 can pivot up and down with respect to the bracket 22. A ledge 25 is provided on the bracket 22, and a latch spring 26 acts to bias the latch-plate 23 up against the ledge 25.

CONSTRUCTION AND OPERATION OF DOOR LATCH

Attached firmly to the front plate 15 is a latch-hook 28. The front plate 15 has a hole 27 into which the latch-plate 23 may enter when the door is closed. It is arranged that when the latch-plate 23 is biassed against the ledge 25, and when the door is closed, the latch-hook 28 protrudes through an aperture 29 as shown in FIG. 4. The back-edge 30 of the aperture 29 thus strikes the hook 28 if an attempt is made to open the door. Thus, the door can only be opened if an unlatching means is provided that is effective to press the latch-plate 23 downwards far enough for the back edge 30 to clear the hook 28. Of course, it is arranged that the unlatching means will press the latch plate 23 down only when the correct coinage is fed into a coin-responsive mechanism.

CONSTRUCTION OF COIN-RESPONSIVE MECHANISM

Formed in the front plate 15 are two coin slots 31, 32. The smaller 31 accepts only dimes, and the larger 32 accepts quarters and nickels. Coins placed in these slots fall into the coin-responsive mechanism 33, shown pictorially in FIG. 7.

The mechanism 33 comprises firstly a base-plate 34. The base-plate 34 is secured to the front plate 15 by means of a tongue-and-slot engagement. Four tongues 35 engage slots in the base-plate in the manner illustrated in FIG. 7. The base-plate 34 is held down in the slots 35 by the wedge 36. To remove the base-plate 34, a serviceman simply slides the wedge to the right and lifts out the base-plate 34. No tools are needed to remove the base plate. The base-plate 34 is generally L-shaped, having a horizontal platform portion 37. The latch-hook 28 forms part of a latch-hook-bracket 38 that is screwed to the platform 37.

CONSTRUCTION OF COIN-CHUTES

Figure 6:
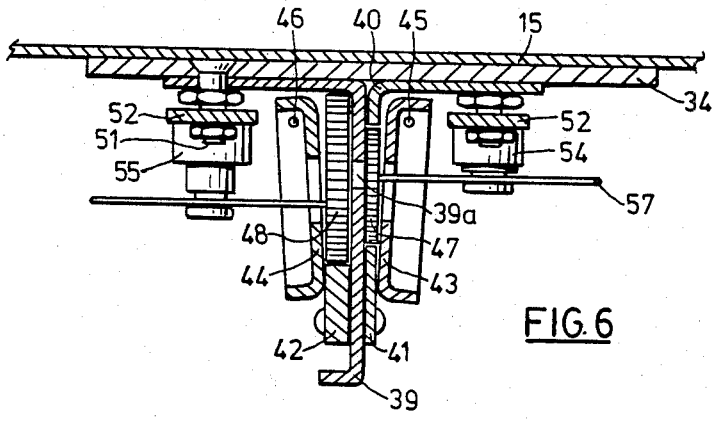
FIG. 6 is a section along line VI—VI of FIG. 5.

Fixed rigidly to the base plate 34 is a chute partition 39. Fixed to the base-plate 34 and touching the chute partition 39 is a dime-chute-stop 40. Both the dime-chute-stop 40, and a dime-chute-spacer 41, are made of metal that is a little thicker than a dime. A quarter-chute-spacer 42 is similarly made of metal that is a little thicker than a quarter. The dime-chute-spacer 41 and the quarter-chute-spacer 42 are riveted to each other one each side of the chute-partition 39. The dime chute and the quarter chute are each completed by respective hinged chute-gates 43,44. These gates are hinged on hinge-pins 45,46 and are spring-loaded (in a manner to be described later) against the respective spacers 41,42. The axes of the hinges are parallel to and alongside the vertical longitudinal axes of the chutes. Having the hinge axes vertical provides for a controlled opening of the gates: if the gates were to open too far, then coins could be lost, as happened sometimes in previous constructions that had the hinge axes horizontal. A dime 47 dropped into the dime-chute, and a quarter 48 dropped into the quarter chute, rest in the respective chutes in the manner shown in FIG. 6. The hinge-pins 45,46 have respective loops 49,50 formed in them, by which the pin may be temporarily shortened, by squeezing the loop, for the purpose of assembling the pins into tabs in the base-plate 34.

CONSTRUCTION OF PRICE-CHANGE-SLIDE

Figure 7:
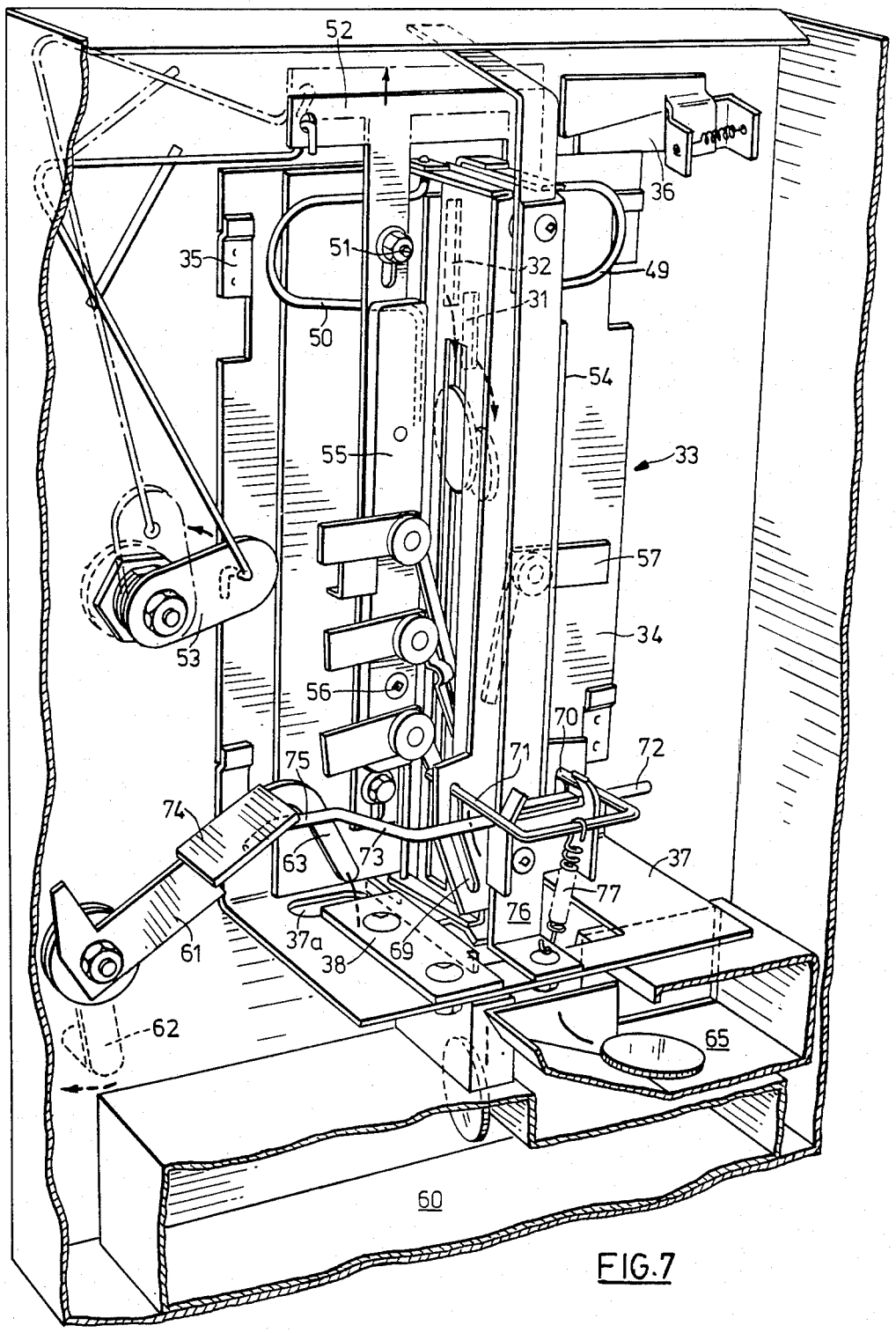
FIG.7 is a general perspective view of the coin-responsive mechanism.

Guide-pillars 51 are fixed to the base-plate 34. In fact, the pillars 51 serve as the means for fixing the chute-partition 39, and the dime-chute-stop 40 to the base-plate 34, but the main purpose of the pillars 51 is to provide a guiding means on which a price-change-slide 52 may slide up and down relative to the base-plate 34. The two positions of the price-change-slide 52 are shown in FIG. 7, one in dotted outline. A key-operated lever 53 effects the movement of the slide 52, and holds it in one of the extremes of its travel. Movement of the price-change-slide 52 is effective to make the coin-responsive mechanism operate with different combinations of coins, so that different coins are necessary to open the box; for instance, at weekends as compared with weekdays. The manner of its operation will become clear presently.

CONSTRUCTION OF PAWL-BLOCKS

Attached to the price-change-slide 52 are two pawl-blocks, a dime-pawl-block 54 and a nickel-quarter-pawl-block 55. These pawl-blocks are conveniently made of plastic and are secured to the slide 52 each with only one bolt or screw, the screw 56 securing the nickel-quarter-pawl-block 55 being shown in FIG. 7. A spigot (not shown) on the block 55 engages a hole in the slide 52 to complete the location of the block 55. Pawl levers 57 are mounted freely on pivots on the blocks 54,55.

OPERATION OF PAWLS

The pawl levers 57 have arms that protrude into the coin chutes. Each of the chute-gates 43,44 is formed with a respective slot to permit this, as may be seen particularly in FIG. 6. It will also be seen that the pawl-lever arms rest against the chute-partition 39. Sometimes it will be desirable for one or more of the pawl-levers to protrude right through both chutes, so that a vending price may be made up of combinations of coins in both chutes; such a chute-crossing pawl is not illustrated here, but may be provided in a manner corresponding to that described and illustrated in the U.S. Pat. No. 4,375,844 referred to above. The chute-partition 39 also has a slot **39*a*** through which chute-crossing pawls may pass from one chute to the other.

The pawl-levers 57 act as one-way or coin-check-valves. The pawls are set so that when a particular combination of coins is present in the chute, one of the pawls just rests on top of the topmost coin: the coins cannot then rise up the chute. If the coins do not reach any pawl, then the coins may rise, if urged upwards. If a stack of coins is too high, the pawl is pushed aside and again the coins may rise up the chute, if urged upwards. Only if the stack of coins is just the right height will the stack be held down in the chute against a force urging the stack upwards. Each pawl is set to cater for a particular combination of coins. It will now be appreciated how moving the price-change slide 52 can be effective to bring a different group of pawls into operation, to cater for different coin combinations. This action (though not the mounting) of the pawls 57 is conventional, and again more details may be found in the U.S. Pat. No. 4,375,844.

DESCRIPTION OF COIN-RESPONSIVE UNLATCHING

The chutes are closed at the bottom by a chute-closure-member 58. The closure-member 58 in fact is one and the same piece with the latch-plate 23 in this particular embodiment; pressing the closure-member 58 down is thus the same as pressing the latch-plate 23 down, which, it will be recalled, needs to be done to release the latch-plate 23 from the hook 28, to open the door. Coins placed in the chutes rest against the closure-member 58, which is upwardly biassed by the latch-spring 26.

Figure 8:
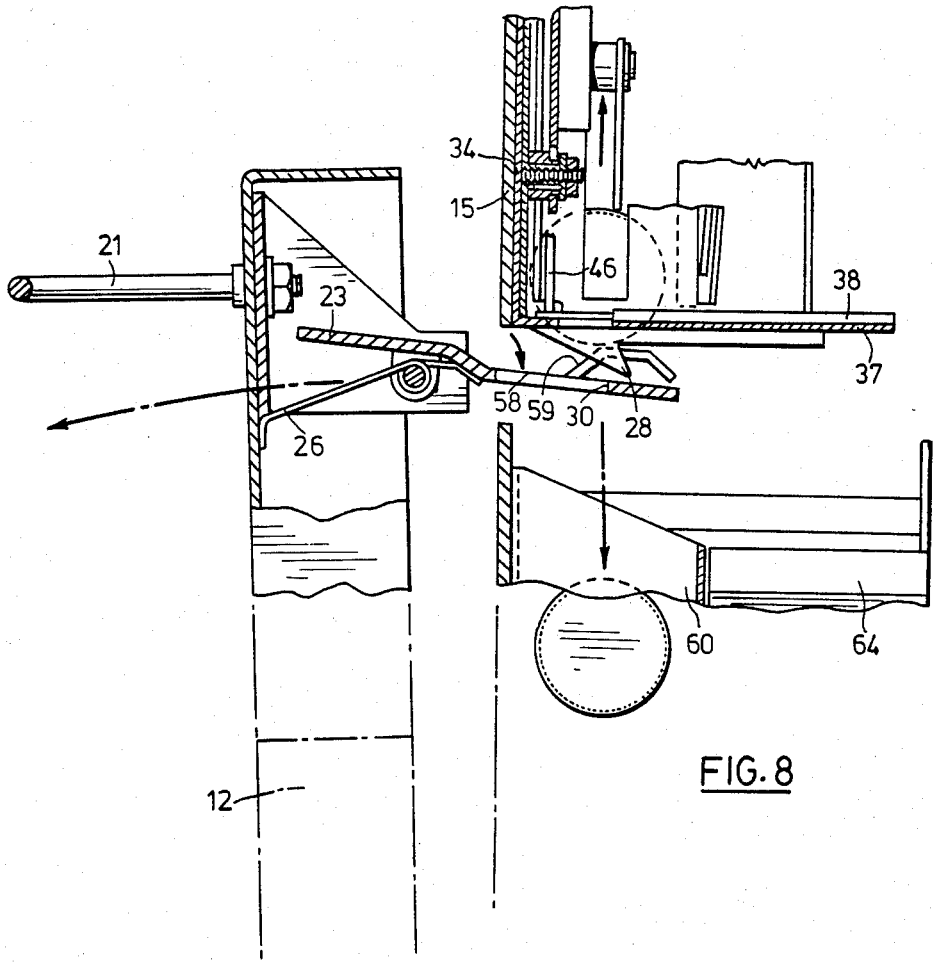
FIG. 8 is a section corresponding to that of FIG. 4, but with the mechanism in a different condition.

The closure-member 58 also includes a camming surface 59. When the handle 21 is moved to the left (FIG. 4), coins in the chute come into engagement with the camming surface 59. If the coins in the chute are permitted to rise up the chute, they will do so under the influence of the camming action, and the latch-plate 23 will remain up, and the door cannot be opened. If, however, the coins are prevented from rising up in of the chutes by the action of the pawls, then by the camming action the closure-member 58 will be forced to move down. Latch-plate 23 moves down in unison, clear of the hook 28, and the door may now be opened. This is the condition illustrated in FIG. 8. It will be observed that now the closure member 58 is being withdrawn transversely aside, clear of the bottom of the chute. Coins in either or both of the chutes are free to fall. They fall, as shown in FIG. 8, straight down into the mouth of the accepted-coin-tray 60.

CONSTRUCTION AND OPERATION OF COIN-RETURN FACILITY

Figure 9:
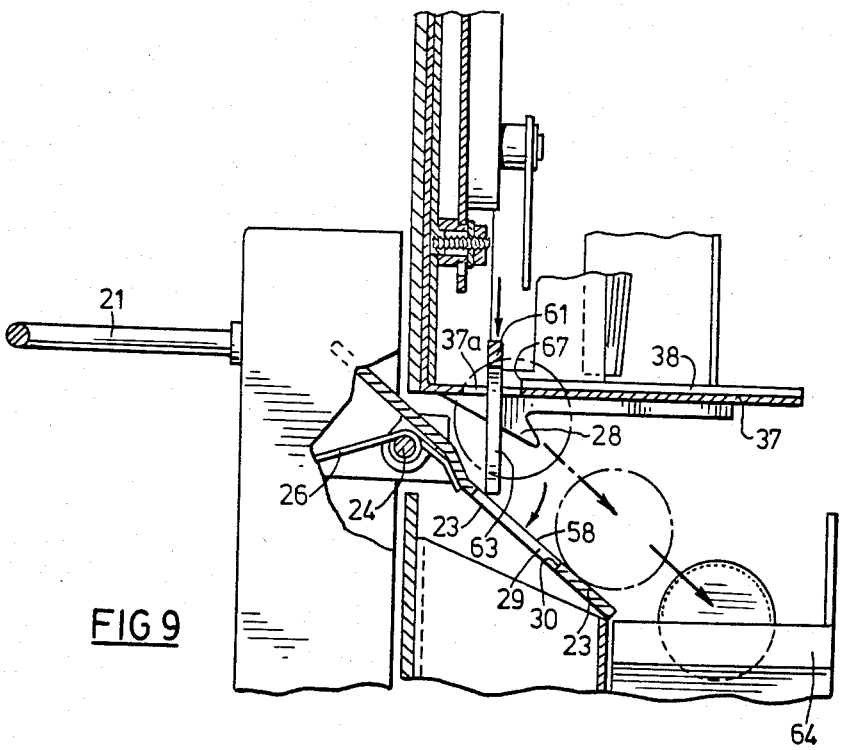
FIG. 9 is also a section corresponding to that of FIG. 4, but with the mechanism in yet another different condition.

A coin return facility is provided. This comprises a movable member 61, which is secured to, and operated by a coin-return-handle 62. The member 61 takes the form of a lever which has a tappet 63 formed on it. When a person operates the handle 62, he causes the tappet 63 to move downwards, through the hole 37*a* in the platform 37 (FIG. 7), and to come into engagement with the closure-member 58. If he presses the coin-return-handle 62 far enough, the closure-member 58 will pivot downwards, against the biassing action of the latch-spring 26, until it takes up the position illustrated in FIG. 9. At this stage, the bottom of the coin chute is opened sufficiently for coins in either of the chutes to fall, and to roll or slide down the now steeply sloping combined closure-member 58 and latch plate 23. They roll into the mouth 64 of the rejected-coin-tray 65, from which they may be retrieved via a coin retrieval opening hole 66 in the front plate 15.

When the combined closure-member 58 and latch-plate 23 is thus depressed the back edge 30 of the aperture 29 is, of course, well clear of the hook 28. It would appear that the door therefore could be opened. This is not the case, however, because the tappet 63, when it moves down, is now placed in the path of the front edge 67 (FIG. 10) of the ledge 25. The ledge 25 forms part of the bracket 22 which is in turn fixed to the door 12. Therefore, the first thing that happens when a person operates the coin-return-handle 62 is that movement of the ledge 25 is blocked by the tappet 63 (to hold the door closed), before the closure-member 58 can be pressed down to its coin-return position. The manner in which the tappet 63 blocks the ledge 25 can be seen particularly in FIG. 11.

CONSTRUCTION AND OPERATION OF CHUTE-UNJAMMING FACILITY

In addition to pressing down the combined closure member and latch plate 23, operation of the coin-return handle 62 is also effective to cause the gates 43,44 to separate and thus to open the chutes. If coins have become jammed in the chutes, (as can happen for example if a bent coin is inserted) opening the gates 43,44 is effective to free the coins so that they can fall.

Figure 11:
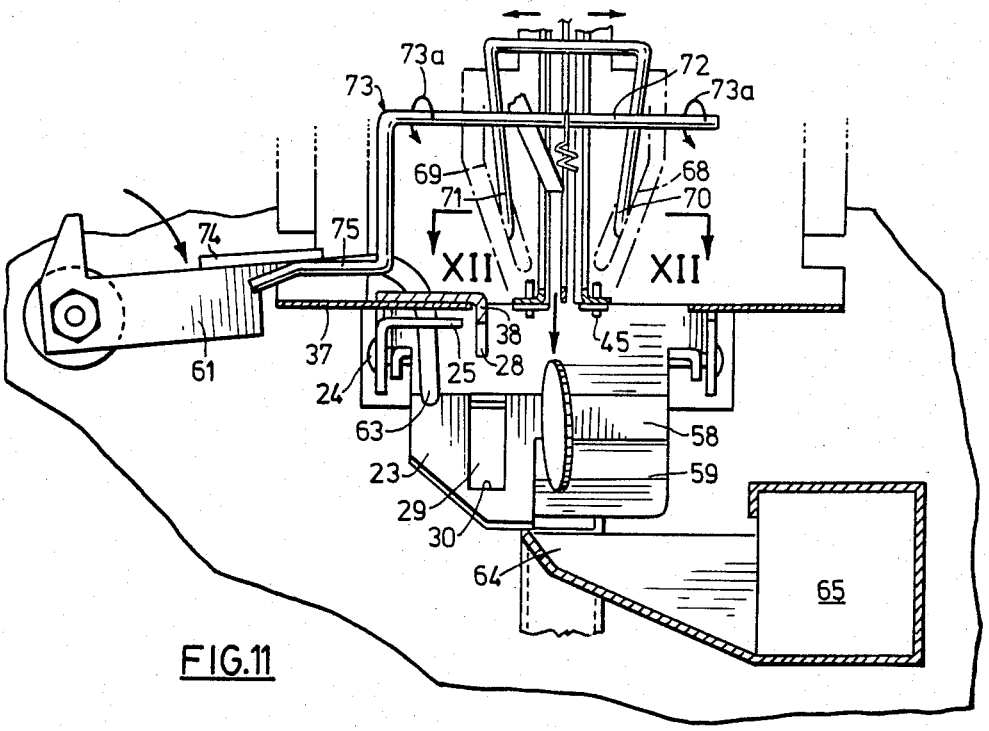
FIG. 11 is a view similar to that of FIG. 5, but with the mechanism in the condition illustrated in FIG. 8.

The gates 43,44 each have a respective cam-slot 68,69 disposed as shown in FIGS. 7 and 11. Into these cam-slots 68,69 protrude respective gate control members in the form of probes or rods 70,71. The rods 70,71 are fixed, as by welding, to a cross-bar 72 of a crank lever 73. A tab 74 of the coin-return lever 61 engages a crank-arm 75 of the crank-lever 73, and causes the crank-lever 73 to rotate when the coin return handle is turned, as shown by arrows 73*a*. The lever 73 is positioned in a fold in a bracket 76 in which it is constrained against movements other than the pivoting described. The bracket 76 is bolted to the platform 37, and also to the chute-partition 39 for stability.

A gate-control-spring 77 acts on the crank-lever 73 in a direction to urge the probes or rods 70,71 upwards. In tending to move upwards, the rods, via the coin-slots 68,69, urge the two chute gates 43,44 together; that is so that they rest against the respective chute spacers 41,42. No separate stop is provided on the crank-lever 73, so that the spring 77 rotates the lever 73 until the position is reached where the gates rest against the chute spacers 41,42. Also, the same gate-control-spring 77 is effective to return the movable member, or coin-return-lever 61 and handle 62 to their normal rest positions. Thus the same spring that acts to hold the chute gates closed also acts to retain the coin-return handle in its normal position. (This may be compared with the multiplicity of springs required to achieve all these functions in prior art devices).

FEATURES OF THE MECHANISM

The mechanism described has virtually all the features that have been found to be desirable in the development of the art in coin-responsive mechanisms together with new ones. In particular, it has chutes with one-way valves in the form of pivoting pawls; the pawls can slide on a simple slider when necessary to change the price at which the mechanism operates: the pawls are mounted on pawl-blocks which are extremely simple to remove for service; the mechanism has a coin return facility that serves to prevent the cabinet being opened when a coin is being returned, that opens the chutes to allow jammed coins to clear, and that needs only one spring to hold the chutes closed and the return handle in its normal position. The main feature though is that all these things are achieved without the need for a moving chute, and that fact means that the components are all simple to make and assemble: virtually all the parts are simple stampings in sheet steel, or simple turned parts. The components of the mechanism itself are not spot-welded, which means that the components can be finished with the kind of protective coating that would be destroyed if the parts were welded.

Another benefit following from the simplicity of the mechanism that is made possible in the present invention is that of improved accuracy of control of the positioning of the pawls. The difference in the aggregate height of an improper stack of coins from that of a proper stack can be quite small: it is important that the pawls are mounted accurately enough to pick up the difference. The invention provides a relative freedom from cumulative manufacturing errors, and eases the problem.

What is claimed is:

1. Coin-responsive mechanism for opening the door of a cabinet, comprising:

an accepted-coin tray and a coin-return tray;

at least one coin-chute;

a manually operable coin-return means;

the door of the cabinet being normally latched closed, unlatching means being provided to unlatch the door in dependence upon the presence of correct coinage in the chute;

a combined chute closure member and latch member, mounted on a pivot which is itself mounted on the door, so that when the door moves the combined member is constrained to move in unison;

wherein the combined member is normally disposed in position at the bottom of the chute such that a coin placed in the chute falls down the chute and comes to rest against the combined member;

wherein the combined member is engageable with a complementary latch member mounted on the fixed part of the cabinet, engageable normally to hold the door latched closed;

wherein the combined member is spring-biassed upwards about its pivot against the bottom of the chute;

at least one coin check valve being so positioned in the chute that correct coinage placed in the chute is trapped therein and prevented from moving back up the chute by the valve;

wherein a camming surface is formed on the combined member;

wherein the combined member is movable to open the bottom of the chute in two modes of movement, namely:

wherein the coin-chute itself is not movable to a position over the coin-return tray; and wherein the manually operable coin-return means includes a movable member having a tappet which is engageable with the combined member upon operation of the coin-return means and is effective to press the combined member downwards away from the bottom of the chute, against the spring biassing.

2. Mechanism as claimed in claim 1, wherein the movable member includes a blocking means, so arranged that when the coin-return means is operated, the blocking means moves into a position where it prevents opening movement of the door.

3. Mechanism as claimed in claim 2, wherein the arrangement is such that when the coin-return means is operated the blocking means is moved into the said position before the combined member is tipped downwards.

4. Mechanism as claimed in claims 1, 2 or 3, wherein the chute, or each of the chutes, is provided with a respective movable gate, and wherein operation of the coin-return means is effective to move the gate, or gates to open the chute or chutes to allow coins jammed in the chute or chutes to fall clear.

5. Mechanism as claimed in claims 1, 2 or 3, wherein the chute, or each of the chutes, is provided with a respective movable gate, and wherein operation of the coin-return means is effective to move the gate, or gates to open the chute or chutes to allow coins jammed in the chute or chutes to fall clear and, wherein each movable gate is hinged about an axis disposed parallel to and alongside the longitudinal axis of the respective chute.

6. Mechanism as claimed in claim 1, wherein the chute, or each of the chutes, is provided with a respective movable gate, and wherein operation of the coin-return means is effective to move the gate, or gates to open the chute or chutes to allow coins jammed in the chute or chutes to fall clear wherein each gate is in operative engagement with a respective gate-control member;

each gate-control member is biassed to a normal position by means of a gate-control-spring; and operation of the coin-return means is effective to cause movement of each gate-control member, against the spring, to cause the gate to move to open the respective chute.

7. Mechanism as claimed in claim 6, wherein each gate includes an angled slot;

each gate-control member comprises a probe, positioned in the slot;

the movable member is in operative engagement with a crank which is in turn in operative engagement with each probe, and so arranged that movement of the movable member is transmitted via the crank to the robes, as a consequence of which movement of the movable member is effective to open the chutes.

8. Mechanism as claimed in claim 7, wherein the gate-control spring is arranged to act upon the crank, and is effective to biass the crank in such a direction that the probes act in the slots to urge each gate to close its respective chute; and the same spring is also effective to biass the crank so that the spring force is transmitted to the movable member and urges the movable member to a normal position.

9. Mechanism as claimed in claim 8, wherein the movable member is relatively immovably secured to a coin-return handle, both of which are mounted on a pviot which is itself mounted on the fixed part of the cabinet, so that the gate-control spring is thereby effective to urge the coin-return handle to a normal position.

10. Mechanism as claimed in claim 1, wherein the chute, or each of the chutes, is provided with a respective movable gate, and wherein operation of the coin-return means is effective to move the gate, or gates to open the chute or chutes to allow coins jammed in the chute or chutes to fall clear wherein each gate is in operative engagement with a respective gate-control member;

each gate-control member is biassed to a normal position by means of a gate-control-spring; and operation of the coin-return means is effective to cause movement of each gate-control member, against the spring, to cause the gate to move to open the respective chute;

wherein two chutes are provided, disposed one each side of a partition;

respective spacers defining the width of the chutes are fixed to the partition, one on each side;

the gates are spring biassed normally into contact with the respective spacers, the chutes being defined as the spaces left between the partition and the respective gates.

11. Mechanism as claimed in claim 10, wherein the partition is immovably secured to a base-plate.

12. Mechanism as claimed in claim 11, wherein the base plate is secured to a fixed part of the cabinet by means of a tongue-and-slot engagement with the fixed part of the cabinet, the engagement being held firmly locked by means of a wedge acting between the said fixed part and the base-plate.

13. Mechanism as claimed in claim 12, wherein the wedge is spring biassed with respect to the fixed part of the cabinet, whereby the base plate can be dismantled from the fixed part of the cabinet, without tools, by moving the wedge against the spring.

14. Mechanism as claimed in claim 1, 2 or 3, wherein a coin check valve comprises a pawl and wherein the pawl is pivoted to a pawl mounting block, and wherein the pawl mounting block is detachably secured to a movable price-change member.

15. Mechanism as claimed in claim 14, wherein the price change member is slidable on guides;

wherein each chute is provided with at least one pawl;

wherein respective pawl mounting blocks are provided, one for each chute, each pawl being pivotally mounted on one of the mounting blocks;

and wherein the pawl mounting blocks are each detachably secured to the price change member.

16. Mechanism as claimed in claim 14, wherein the price change member is mounted for sliding with respect to the base-plate on guide-pillars fixed to the base-plate, and wherein the price-change member is lockable in either of two pre-determined positions with respect to the base plate.

17. Mechanism as claimed in claim 14, wherein the price change member is mounted for sliding with respect to the base-plate on guide-pillars fixed to the base-plate, and wherein the price-change member is lockable in either of two pre-determined positions with respect to the base plate;.

wherein each chute is provided with at least one pawl;

wherein respective pawl mounting blocks are provided, one for each chute, each pawl being pivotally mounted on one of the mounting blocks;

and wherein the pawl mounting blocks are each detachably secured to the price change member.

18. Coin-responsive mechanism for opening the door of a cabinet, comprising:

an accepted-coin tray and a coin-return tray;

at least one coin chute;

the door of the cabinet being normally latched closed, unlatching means being provided to unlatch the door in accordance with the presence of correct coinage in the chute;

a chute closure member, which is mounted on a pivot;

wherein the chute closure member is normally disposed in position at the bottom of the chute such that a coin placed in the chute falls down the chute and comes to rest against the closure member;

a means for transmitting movement of the chute closure member to the unlatching means;

a coin-accept means which is responsive both to the presence of correct coinage in the chute and also to the action by a person of opening the door;

where the coin-accept means is effective in response to the said presence and the said action firstly to move the chute closure member about its pivot a comparatively small distance;

where that small distance is large enough that the movement transmitted from the chute closure member to the unlatching means by the means for transmitting movement therebetween is large enough to unlatch the door, but the movement of the chute closure member is small enough that a coin in the chute cannot fall from the chute due to the movement per se of the chute closure member about its pivot;

where the coin-accept means is effective in response to the said presence and the said action secondly to move the chute closure member transversely aside far enough to clear the bottom of the chute and to allow a coin in the chute to fall therefrom;

where the accepted-coin tray is so positioned below the chute that coins falling from the chute when the chute closure member moves transversely aside fall into the accepted-coin tray;

manually operable coin-return means, which is effective, when operated and when the door is closed, firstly to move the chute closure member about its pivot a comparatively large distance;

where that large distance is large enough to allow a coin to emerge from the bottom of the chute and to roll or slide down the chute closure member;

where the coin-return tray is so positioned in relation to the chute closure member that coins rolling or sliding down the chute closure member when the chute closure member moves about its pivot through the large distance fall into the coin-return tray;

where the coin-return means is effective, when operated and when the door is closed, secondly to prevent movement of the chute closure member transversely away from the bottom of the chute, thereby to prevent entry of a coin into the accepted-coin tray;

and wherein the chute itself is not movable to a position over the coin-return tray.

19. Mechanism as claimed in claim 18, wherein the pivot on which the chute closure member is mounted, and about which it performs its tipping movement, is itself mounted on the door, so that when the door moves the closure member is constrained to move in unison.

20. Mechanism as claimed in claim 19, wherein the chute closure member is spring biassed upwards, against the bottom of the chute.

21. Mechanism as claimed in claim 18, wherein the mechanism includes a latch means comprising a latch plate member and a latch hook member, one of which is mounted on the door and the other on the fixed part of the cabinet, and the action of opening the door is effective to unlatch the plate from the hook when correct coinage is present in the chute but not when incorrect coinage, or no coinage, is present in the chute.

22. Mechanism as claimed in claim 21, wherein a camming surface is formed on the chute closure member, and wherein at least one coin check valve is provided in the coin chute, arranged so that when correct coinage is placed in the chute:

coins are blocked against upward movement back up the chute by the valve;

a coin blocked by the valve engages the camming surface;

continued opening movement of the door causes the camming surface, and with it the closure member, to tip downwards, against the spring-biassing; and the tipping movement of the closure member is transmitted to the latch means to unlatch the plate from the hook.

23. Mechanism as claimed in claim 22, wherein one of the latch members is pivoted for latching and unlatching about a pivot fixed to the door.

24. Mechanism as claimed in claim 23, wherein the pivotable latch member is one and the same piece as the chute-closure member.

25. Mechanism as claimed in claim 24 wherein the pivotable latch member is the latch plate member.

* * * * *